United States Patent [19]

Williams

[11] Patent Number: 4,646,480

[45] Date of Patent: Mar. 3, 1987

[54] PRESSURIZED ABRASIVE CLEANING DEVICE FOR USE WITH PLASTIC ABRASIVE PARTICLES

[75] Inventor: Raymond F. Williams, Bolivar, Ohio

[73] Assignee: Inventive Machine Corporation, Bolivar, Ohio

[21] Appl. No.: 790,334

[22] Filed: Oct. 23, 1985

[51] Int. Cl.[4] ..... B24C 5/04

[52] U.S. Cl. ..... 51/424; 51/439; 51/427; 51/273

[58] Field of Search ..... 51/424, 425, 439, 427, 51/410, 273, 320, 319

[56] References Cited

U.S. PATENT DOCUMENTS

| | | | |
|---|---|---|---|
| 2,723,498 | 11/1955 | Hastrup et al. | 51/425 |
| 2,846,822 | 8/1958 | Steffen | 51/424 |
| 3,075,318 | 1/1963 | Dilliard et al. | 51/439 |
| 3,837,383 | 9/1974 | Ko | 51/273 |
| 4,045,915 | 9/1977 | Gilbert et al. | 51/427 |
| 4,212,138 | 7/1980 | Hutchinson | 51/427 |
| 4,281,485 | 8/1981 | Charity, III | 51/425 |
| 4,333,277 | 6/1982 | Tasedan | 51/425 |
| 4,395,850 | 8/1983 | Brown | 51/427 |

FOREIGN PATENT DOCUMENTS

| | | | |
|---|---|---|---|
| 2318426 | 10/1973 | Fed. Rep. of Germany | 51/273 |
| 764171 | 12/1956 | United Kingdom | 51/425 |

*Primary Examiner*—Frederick R. Schmidt
*Assistant Examiner*—Robert A. Rose
*Attorney, Agent, or Firm*—Sand & Hudak Co.

[57] ABSTRACT

An improved device for cleaning surfaces with plastic abrasive particles and for recovering the spent abrasive particles and debris removed from the surface in which the stream of abrasive particles is visible as it impinges against the surface being cleaned. A venturi nozzle adapted to be connected to a supply of pressurized air containing plastic abrasive particles is mounted on an end wall of a housing which forms a vacuum chamber. The housing includes a cylindrical glass sleeve which is removably mounted on a collar at its inner end and which is retained at its outer end by a retaining ring connected to the collar by a plurality of straps. A work ring is mounted on the outer end of the glass sleeve and is moved along the surface being cleaned. An exhaust tube adapted to be connected to a source of suction is connected to a rear end of the housing and the inlet end of the nozzle is located concentrically with the exhaust tube whereby the pressurized air supply line is mounted within the exhaust tube line. The removable glass sleeve of the housing provides visibility of the surface being cleaned by the stream of pressurized air and entrained plastic abrasive particles enabling the amount of dwell time of the stream of abrasive particles against the surface to be accurately controlled.

13 Claims, 8 Drawing Figures

PRESSURIZED ABRASIVE CLEANING DEVICE FOR USE WITH PLASTIC ABRASIVE PARTICLES

TECHNICAL FIELD

The invention relates to devices for cleaning surfaces and in particular to devices which use plastic abrasive particles entrained in a stream of high pressure air as the cleaning substance. More particularly, the invention relates to such cleaning devices in which the spent abrasive particles and debris are captured within the device and removed by a vacuum source and collected in a recovery unit to prevent escape of the particles and debris into the surrounding atmosphere. Even more particularly, the invention relates to such devices in which the housing which forms the vacuum chamber includes a removable glass sleeve which provides visibility to the surface being cleaned to accurately control the amount of dwell time that the stream of pressurized abrasive particles is impinged against the surface.

BACKGROUND ART

Abrasive cleaning devices commonly referred to as sandblasters, have been used for a considerable number of years in the cleaning industry for cleaning various surfaces. Heretofore, a supply of abrasive particles, such as sand, is entrained in a stream of high pressure air and fed into a nozzle from which it is ejected and impinged against the surface to be cleaned. The high pressure abrasive particles remove dirt and debris from the surface and provide an extremely satisfactory cleaning means. However, considerable problems are involved with such abrasive cleaning operations. Many of the cleaning operations are performed in enclosed places such as the interior of tank cars, ships' hauls, or in factories and other locations where the spent abrasive particles and debris enter the air and become deposited on the surrounding equipment. Also, when the cleaning is done in a confined place, the duct that is created is so intense that the blasting can be performed only for short periods of time after which the operator must wait until the dust settles and visibility increases before continuing. This results in wasted time and increases considerably the cost of the cleaning operation. The generated dust also is a serious problem even when the cleaning operation is performed in outside environments due to the pollution created thereby.

Devices have overcome this problem by removing the spent abrasive particles and debris from within the cleaning nozzle by placing a vacuum thereon. In these devices, the spent abrasive particles and removed debris is retained within the nozzle housing and is withdrawn from the housing by a vacuum and returned to a collection on recycling equipment. This enables the spent abrasive particles to be reused thereby increasing the cost efficiency of the operation and prevents the removed paint, rust, and other debris from the cleaned surface from being ejected into the surrounding atmosphere. Examples of such pressurized abrasive systems having the vacuum recovery system are shown in U.S. Pat. Nos. 2,723,498; 2,846,822; 4,045,915; 4,433,277; 4,395,850; and United Kingdom Pat. No. 764,174.

Although these prior devices do perform satisfactory for many cleaning operations, they do have the disadvantage of not permitting the operator to view the surface while it is being cleaned. Although this is not a problem for many cleaning operations, it does present a problem for the abrasive cleaning of thin skinned or sensitive material such as used in aircraft, certain molds, fiberglass, or similar materials and structures. If the dwell time, that is the length of time that the pressurized abrasive stream is directed against one particular area, is excessive for such thin skinned material, the material will be distorted and damaged.

This problem has required many thin skinned and sensitive type materials to be cleaned by other methods such as chemicals. For example, in the aircraft industry, nearly all planes cannot be cleaned abrasively due to the sensitivity of the skin or thin metal of the aircraft and must be removed chemically. This cleaning operation requires a considerable amount of time and expense and in addition, creates a toxic, hazardous material or by-product that must be disposed of properly.

Recently plastic abrasive particles have been developed which have found considerable success in the cleaning of such thin skinned and sensitive material. The lightweight of the plastic abrasive enables a low pressure to be used for impinging the plastic particles against the surface being cleaned. The lower pressure is possible since the weight of the plastic is approximately one-third of that of the heretofore commonly used sand particles. Although these plastic abrasive particles have found considerable success in the cleaning of thin skinned materials, the cleaning devices used therefore still have the problem of not enabling the operator to accurately regulate the dwell time that the abrasive particle stream impinges against the surface since the operator cannot see the particular area being cleaned since it is hidden within the housing that forms the vacuum chamber. It is desirable that the operator permits the abrasive streams to impinge against the surface only long enough to remove the debris and paint. The ability to accurately control the dwell time reduces considerably the amount of time required for cleaning a particular surface as well as preventing possible injury to the surface by an excess dwell time.

Therefore, the need has existed for an improved abrasive cleaning device for use with plastic abrasive particles which enables the operator to see the stream of abrasive particles as it impinges against a surface thereby enabling the dwell time to be accurately controlled which heretofore was not readily possible with prior abrasive cleaning devices.

Another problem with prior abrasive cleaning devices is that the cleaning head or vacuum chamber forming housing required two hoses to be connected to the housing. One hose, commonly referred to as the blast hose, carries the pressurized stream of abrasive particles, and the other hose, referred to as the vacuum hose, is attached to the cleaning head and source of suction to create the vacuum within the housing to remove the spent abrasive particles and debris. These two hoses increase the difficulty for the operator to manipulate the cleaning head in contrast to a cleaning head or device requiring only a single hose.

U.S. Pat. No. 4,212,138 which is believed to be the closest disclosure of the subject invention, discloses a sandblast cleaner in which a flexible hood or shroud is mounted on the end of a usual blast nozzle for confining the spent particles with the shroud. The shroud is provided with a small transparent window formed of a clear plastic material which is sewn into the shroud. The shroud is formed of a flexible woven fabric material which is pervious to air. Although such a device is satisfactory for small certain operations, it would be ineffective for large cleaning jobs, such as an aircraft, since the shroud would have to be continuously emptied manually of the spent abrasive particles and debris. Also the plastic window cannot be located close to the abrasive particle stream and work surface since the particles would hit and scratch the inside surface of the plastic window within a relatively short period of time making its usefulness seriously limited.

DISCLOSURE OF THE INVENTION

Objectives of the invention include providing an improved pressurized abrasive cleaning device for use with plastic abrasive particles for abrasively cleaning a surface and simultaneously recovering nearly all of the abrasive particles and debris, in which the vacuum forming housing includes a removable transparent glass wall which forms a vacuum chamber within the housing enabling the stream of abrasive particles which is impinged against the surface being cleaning to be viewed by the operator enabling the operator to accurately control the amount of dwell time that the particles impinge against the surface. Another objective is to provide such a device in which the housing is connected to a suction exhaust line for recovering nearly all of the spent abrasive particles and debris for reclaiming the abrasive particles in a filtering unit, and in which a venturi nozzle is mounted on the housing with its outlet end located within the vacuum chamber and its inlet end being located concentrically within the exhaust tube means whereby the blast hose through which the pressurized air and abrasive particles is carried to the nozzle is located within a vacuum hose that is connected to the vacuum tube outlet of the housing thereby requiring the operator to control only a single hose at the head of the cleaning device.

A further objective of the invention is to provide such an abrasive cleaning device in which a work ring is removably mounted on an outer end of the housing which maintains close contact with the surface being cleaned to assist in maintaining the abrasive particles and debris within the vacuum chamber for subsequent removal through the exhaust tube.

Still another objective of the invention is to provide such a cleaning device in which the transparent glass wall is a cylindrical sleeve formed of a PYREX material and is slidably mounted in a collar portion of the housing and is retained thereon by an outer retaining ring adjustably clamped against the glass sleeve; and in which the retaining ring is connected to the collar by a plurality of metal straps extending along the exterior of the glass sleeve. A further objective is to provide such a cleaning device in which the nozzle is mounted on a base plate located within the collar; and in which the base plate is provided with the plurality of circular spaced holes extending about the nozzle for applying the vacuum source to the housing enabling the spent abrasive particles and debris to be removed therefrom.

Another objective is to provide such an abrasive cleaning device which eliminates difficulties heretofore encountered with prior cleaning devices, which achieves the objectives simply, efficiently, and economically and solves problems and satisfies needs existing in the art.

These objectives and advantages are obtained by the improved pressurized abrasive cleaning device for use with plastic abrasive particles, the general nature of which may be stated as including a rigid housing having removable transparent glass wall means for forming a vacuum chamber within the housing; a nozzle having inlet and outlet ends mounted on the housing with the outlet and extending into the vacuum chamber, and with the inlet end of the nozzle being adapted to be connected to a source of pressurized air containing abrasive plastic particles for impinging a stream of said abrasive particles against a surface being cleaned with the transparent wall means enabling the stream of abrasive particles to be contained within the vacuum chamber and to be viewed as it impinges against the surface being cleaned; and exhaust means mounted on the housing and communicating with the vacuum chamber and adapted to be connected to a suction source for removing spent abrasive particles and debris trapped within the vacuum chamber preventing their escape into the atmosphere.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
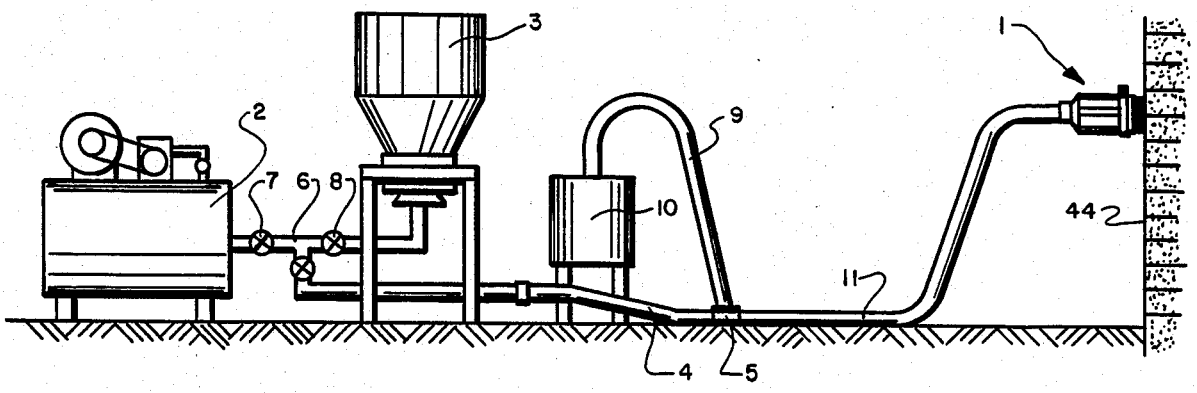
FIG. 1 is a diagrammatic perspective view showing the improved pressurized abrasive cleaning device in combination with the usual pressurized air and abrasive supply equipment being used in cleaning a surface.

The improved pressurized abrasive cleaning device is indicated generally at 1, and is shown in FIG. 1 connected to usual abrasive cleaning equipment. This equipment may include a pressurized air supply system 2 and a hopper 3 containing a supply of plastic abrasive particles which are fed through a supply hose 4 that extends through an adapter 5 before being connected to device 1. Supply hose 4 is connected to a conduit 6 which extends between supply system 2 and hopper 3. Control valve 7 and 8 are located in conduit 6 for regulating the air presure from supply system 2 and for controlling the rate of flow of the plastic abrasive particles from hopper 3 into line 4. An exhaust line 9 extends from a spent abrasive particle collection tank and filtering unit 10 and is connected to adapter 5. Another exhaust line 11 extends from adapter 5 and is connected to improved device 1.

The details of construction of the improved pressurized abrasive cleaning device is shown particularly in FIGS. 2–8. Device 1 includes a main housing indicated generally at 15, which is of a rigid construction formed by a base indicated generally at 16, having a cylindrical collar 17 and a transversely extending end wall 18 located within the collar. End wall 18 preferably is secured to collar 17 by welds or other attachment means. Housing 15 further includes an outer retaining ring 20 connected to base 16 by a plurality of longitudinally extending, relatively rigid metal straps 21, three of which are shown in the drawings, which are spaced equally circumferentially about collar 17. Straps 21 are attached to collar 17 and outer retaining ring 20 by welding or other fastening means. Retaining ring 20 has a split 23 at one location on its circumference so as to provide an adjustable diameter thereto. A clamping device 24 formed by a bolt 25 and nut 26 extends through openings formed in a pair of outwardly extending end flanges 22 which form split 23.

An exhaust tube 30 is mounted on or is formed integrally with collar 17 as shown in the drawings and extends axially rearwardly therefrom. Exhaust tube 30 is connected to exhaust line 11 by a slip fit connection or other attachment means (FIG. 3).

Figure 2:
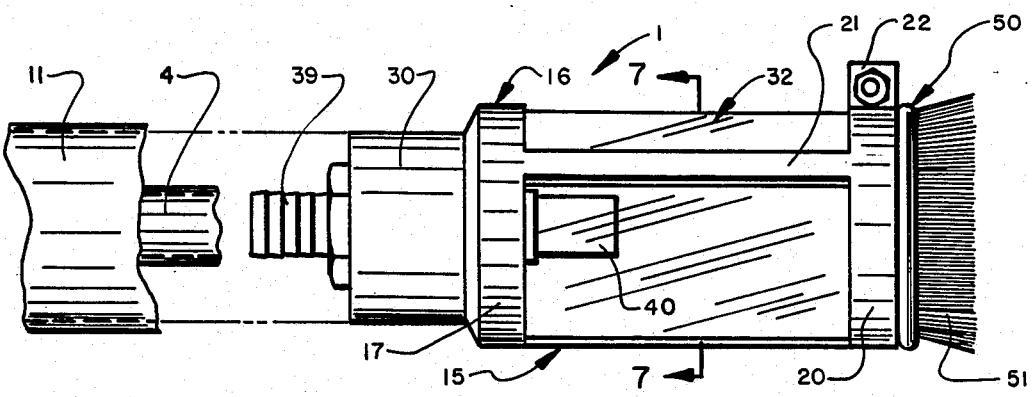
FIG. 2 is an enlarged plan view showing improved abrasive cleaning device disconnected from the vacuum and blast hoses.
Figure 3:
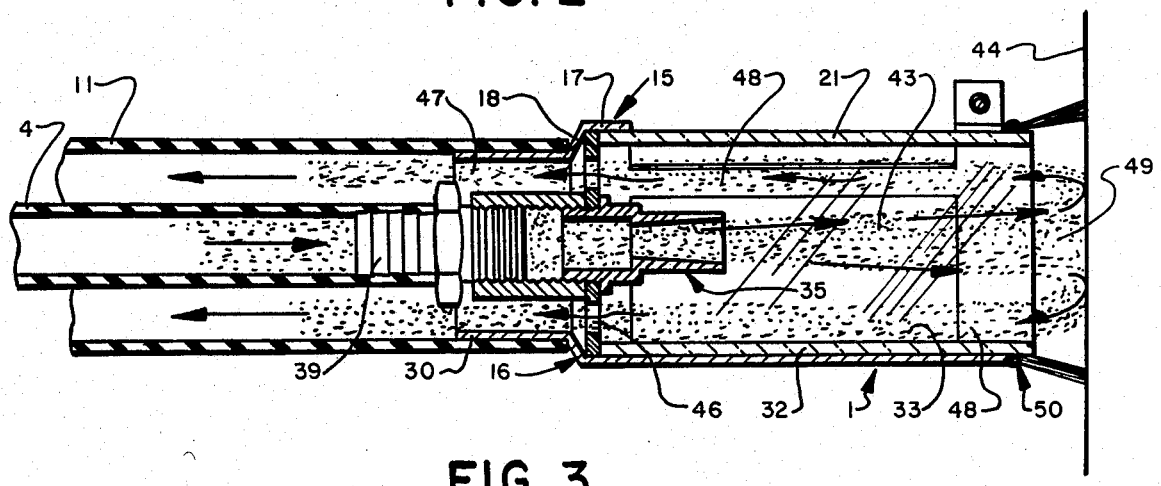
FIG. 3 is a longitudinal sectional view of the improved cleaning device in operation cleaning a surface.
Figure 4:
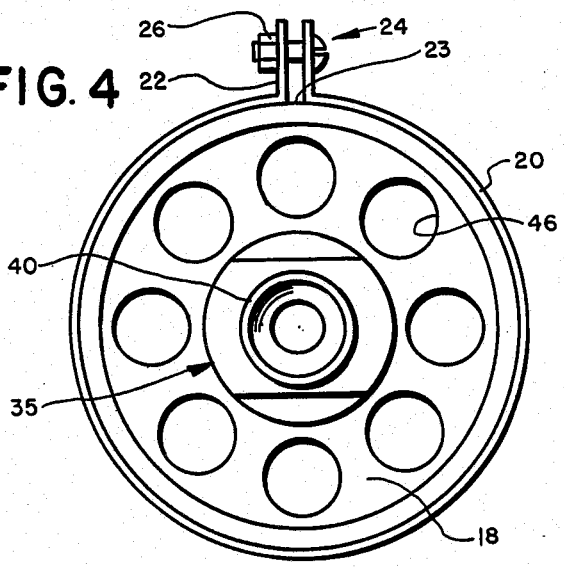
FIG. 4 is a front view of the improved cleaning device with the work ring removed therefrom.
Figure 5:
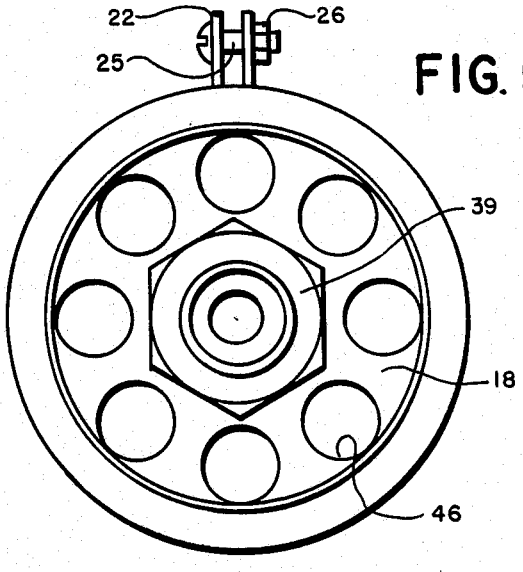
FIG. 5 is a rear view of the improved cleaning device.
Figure 6:
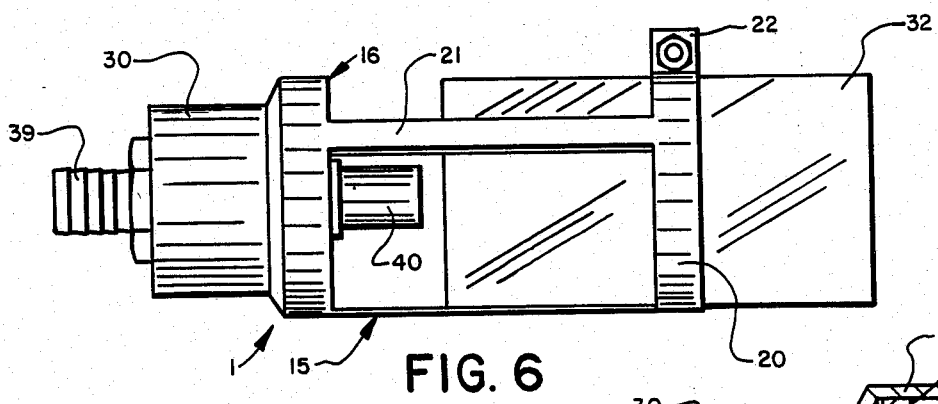
FIG. 6 is a plan view of the cleaning device with the work ring and hoses being removed therefrom and with the glass sleeve being shown partially removed from its mounting collar.
Figure 7:
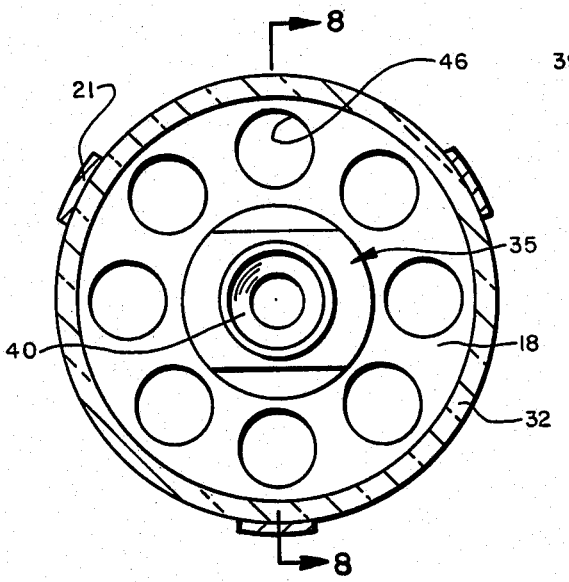
FIG. 7 is a enlarged sectional view taken on lines 7—7, FIG. 2.

In accordance with one of the main features of the invention, housing 15 includes a cylindrical transparent glass sleeve 32 which is removably mounted on and extends between collar 17 and outer retaining ring 20 as shown in FIGS. 2, 3 and 6. Glass sleeve 32 preferably is formed of a hard glass such as PYREX and has an outer diameter complementary to the internal diameter of collar 17 so as to be slidably received therein. Retaining ring 20 is clamped against the outer end of glass sleeve 32 for retaining the sleeve in its mounted position on collar 17. Straps 21 extend along the outer surface of sleeve 32 and together with ring 20 securely mount the sleeve on collar 17 and in addition provides some protection against breakage for the glass sleeve. Sleeve 32 forms a vacuum chamber 33 within the housing as shown in FIG. 3, the interior of which is readily viewed by an operator through the transparent glass sleeve.

Figure 8:
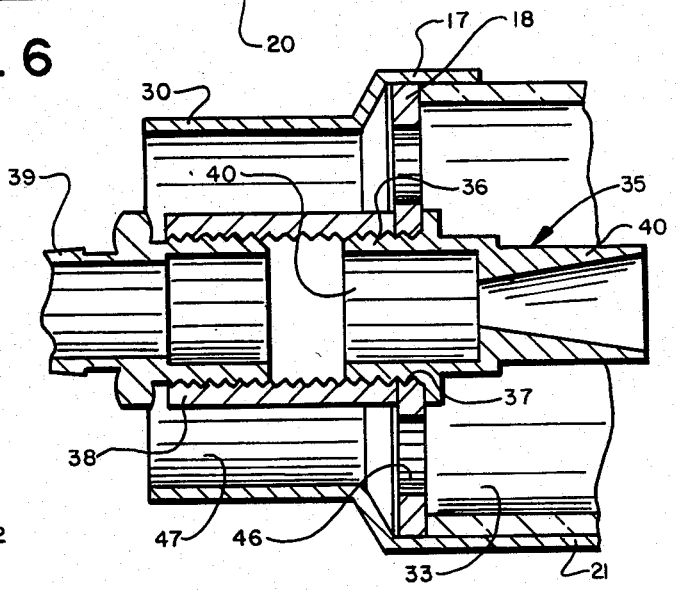
FIG. 8 is a fragmentary sectional view taken on lines 8—8, FIG. 7.

Referring to FIG. 8, a usual venturi nozzle indicated generally at 35, has a threaded end 36 which is mounted within a threaded opening 37 formed in end wall 18 and is connected by a threaded sleeve 38 to a hose coupler 39 which receives the end of air supply hose 4. The outlet end 40 of nozzle 35 extends partially into vacuum chamber 33 for directing a stream of plastic abrasive particles 43 against a surface 44 to be cleaned thereby. Particles 43 are entrained within and carried by the stream of pressurized air which is supplied through hose 4 from air supply 2 in a usual manner as in the prior cleaning devices using sand or similar abrasive particles.

A plurality of holes 46 are formed in housing end wall 18 and provide the communication between vacuum chamber 33 and bore 47 of exhaust tube 30 to permit the spent abrasive particles and debris to be withdrawn from vacuum chamber 33 and into exhaust tube 30 and through line 11 for subsequent deposit in tank and filtering unit 10. In accordance with another feature of the invention as shown in FIG. 3, pressurized abrasive supply hose 4 is located concentrically within vacuum hose or exhaust line 11 for a predetermined distance between improved cleaning device 1 and adapter 5 at which position hose 4 is separated from exhaust line 11 for connection to conduit 6 of air supply 2 and hopper 3. This requires the operator to operate only a single externally visible hose in contrast to the prior abrasive cleaning devices in which the exhaust hose is completely separate from the air supply hose, both of which entered the vacuum housing at different locations.

The operation of the improved cleaning device is shown diagrammatically in FIG. 3. The stream of particles 43 is directed against surface 44 and is completely visible to the operator through glass sleeve 32 with the spent particles 48 being removed through end wall holes 46 and into exhaust tube 30. It has been found that the size of the blast pattern or ring 49 is controlled by the amount of vacuum applied to vacuum chamber 33 as well as the distance from outlet end 40 of nozzle 35 with respect to the outer end of glass sleeve 32. The greater the vacuum on chamber 33, smaller will be the blast pattern 49.

It has been found that the glass sleeve 32 will retain its transparency for a considerably longer period of time than possible with other materials such as various types of plastics, and will require replacement only periodically which is accomplished easily by loosening clamp 24 on retaining ring 20 and sliding sleeve 32 outwardly from collar 18 as shown in FIG. 6 and inserting a new glass sleeve 32 therein. A usual work ring 50 can be removably mounted on the outer end of sleeve 32 and may consist of a ring-like brush 51 or other types of readily known surface engaging work rings.

Improved abrasive cleaning device 1 has a number of features and advantages not believed present in the existing device. In accordance with one of the main features of the invention, vacuum chamber 33 is formed within main housing 15, consisting principally of transparent glass sleeve 32. Sleeve 32 in addition to recovering nearly all of the spent abrasive particles which are ejected through nozzle 35 and impinged against surface 49 together with the debris removed from the cleaned surface, also enables the operator to view the particles being impinged against the surface. The operator can immediately move the work ring along the surface being cleaned as the last of the paint, rust or other surface coating is removed from within blast pattern 49. This elminates the heretofore excessively greater dwell time of the blast pattern on the work surface to insure that all of the material has been removed therefrom since the operator could only guess or estimate when all of the material has been removed. Thus, the blast pattern remains on a particular spot of the surface being cleaned only a minimum amount of time necessary to remove all of the coating on the surface. This maximum dwell time is extremely critical during the pressurized abrasive cleaning of thin skinned or sensitive materials. Also, the spent plastic abrasive particles which are considerably more expensive than the heretofore used abrasive particles such as sand, can be recovered in tank and filtering unit 10 for reuse. In addition to the cost savings achieved by the reuse of abrasive particles, improved device 1 prevents the spent particles and debris from entering the surrounding atmosphere and being deposited on nearby equipment or landscape with the resulting problems.

Another advantage of device 1 is the mounting of pressurized abrasive supply hose 4 within the exhaust line 11, both of which leave housing 15 at the rear thereof eliminating the double hose connection and multiple openings required in prior pressurized abrasive cleaning devices. Still another advantage is that nozzle 15 is removably mounted on end wall 18 by a simple threaded connection enabling nozzles of various sizes to be readily mounted on housing 15 to provide various blast patterns for different pressurized abrasive cleaning applications.

Accordingly, the improved pressurized abrasive cleaning device construction is simplified, provides an effective, safe, inexpensive, and efficient device which achieves all the enumerated objectives, provides for eliminating difficulties encountered with prior devices, and solves problems and obtains new results in the art. In the foregoing description, certain terms have been used for brevity, clearness, and understanding; but no unnecesary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved pressurized abrasive cleaning device is constructed and used, the characteristics of the construction, and the advantageous, new and useful results obtained; the new and useful structures, devices, elements, arrangements, parts, and combinations, are set forth in the appended claims.

What is claimed is:

1. An improved pressurized abrasive cleaning device for use with plastic abrasive particles including:

(a) a rigid housing having a base with a cylindrical collar and a cylindrical glass sleeve having an inner end slidably mounted on said collar providing a removable transparent glass wall means for forming a vacuum chamber within the housing;

(b) a nozzle having inlet and outlet ends mounted on the housing with the outlet end extending into the vacuum chamber, and with the inlet end of the nozzle being adapted to be connected to a source of pressurized air containing abrasive plastic particles for impinging a stream of said abrasive particles against a surface being cleaned with the transparent wall means enabling the stream of abrasive particles to be contained within the vacuum chamber and to be viewed as it impinges against the surface being cleaned; and (c) exhaust means mounted on the housing and comminicating with the vacuum chamber and adapted to be connected to a suction source for removing spent abrasive particles and debris trapped within the vacuum chamber preventing their escape into the atmosphere.

2. The abrasive cleaning device defined in claim 1 in which work ring means is mounted on an outer end of the housing for movement along a surface to be abrasively cleaned.

3. The abrasive cleaning device defined in claim 1 in which a retaining ring is mounted in an axial spaced relationship from the collar by a plurality of straps which extend along the glass sleeve; and in which the retaining ring is mounted about an outer end of the glass sleeve to assist in mounting said sleeve on the collar.

4. The abrasive cleaning device defined in claim 3 in which the diameter of the retaining ring is adjustable for clamping about the outer end of the glass sleeve for removably mounting the sleeve on the collar.

5. The abrasive cleaning device defined in claim 1 in which the base further includes an end wall extending transversely with respect to the collar; and in which the nozzle is mounted on the end wall of the base and is aligned with the longitudinal centerline axis of the glass sleeve.

6. The abrasive cleaning device defined in claim 5 in which the end wall is formed with opening means; and in which the exhaust means is a cylindrical tube mounted concentrically on a rear end of the collar concentric with and extending about the outlet end of the nozzle.

7. The abrasive cleaning device defined in claim 6 in which the opening means is a plurality of holes arranged in a circular manner about the nozzle.

8. The abrasive cleaning device defined in claim 6 in which the end wall has a threaded central opening; and in which the nozzle is threadably mounted in said central opening.

9. The abrasive cleaning device defined in claim 3 in which three equally circumferentially spaced straps mount the retaining ring in an axial spaced relationship on the collar.

10. The abrasive cleaning device defined in claim 6 in which the collar has a larger diameter than the exhaust tube means.

11. The abrasive cleaning device defined in claim 1 in which the nozzle is a venturi style nozzle.

12. The abrasive cleaning device defined in claim 1 in which the cylindrical glass sleeve is formed of PYREX material.

13. The abrasive cleaning device defined in claim 1 in which the exhaust means is connected to a suction source by a first hose; in which the inlet end of the nozzle is connected to a source of pressurized air containing abrasive particles by a second hose; and in which the second hose extends from the housing within said first hose.

* * * * *